US007999779B2

(12) United States Patent
Baik et al.

(10) Patent No.: US 7,999,779 B2
(45) Date of Patent: Aug. 16, 2011

(54) METHOD AND APPARATUS FOR DRIVING LIQUID CRYSTAL DISPLAY DEVICE

(75) Inventors: Seong Ho Baik, Gyeonggi-do (KR); Kyung Joon Kwon, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1242 days.

(21) Appl. No.: 11/151,527

(22) Filed: Jun. 14, 2005

(65) Prior Publication Data

US 2005/0285838 A1 Dec. 29, 2005

(30) Foreign Application Priority Data

Jun. 29, 2004 (KR) ..... 10-2004-0049638

(51) Int. Cl.
*G09G 3/36* (2006.01)

(52) U.S. Cl. ..... 345/98; 345/87

(58) Field of Classification Search ..... 345/204, 345/690, 87, 89, 94–103
See application file for complete search history.

(56) References Cited

U.S. PATENT DOCUMENTS 5,668,569 A * 9/1997 Greene et al. ..... 345/103
6,212,632 B1 * 4/2001 Surine et al. ..... 713/2
7,154,467 B2 * 12/2006 Kojima et al. ..... 345/100
7,375,723 B2 * 5/2008 Cheon et al. ..... 345/204

* cited by examiner

*Primary Examiner* — Nitin Patel
(74) *Attorney, Agent, or Firm* — Morgan, Lewis & Bockius LLP

(57) ABSTRACT

A driving method and a driving apparatus for a liquid crystal display device is provided. A first modulated data of a designated distance is determined and stored in a timing controller. An area existing between the first modulated data is judged using the present frame data and the previous frame data, and a second modulated data is calculated through an approximation in the area to display at least one of the first modulated data and the second modulated data.

12 Claims, 8 Drawing Sheets

61

| | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | | 25 | 39 | 55 | 74 | 95 | 116 | 143 | 167 | 194 | 212 | 231 | 245 | 250 | 255 | 255 | 255 |
| 16 | 0 | | 36 | 52 | 71 | 90 | 111 | 138 | 162 | 191 | 210 | 230 | 242 | 247 | 255 | 255 | 255 |
| 32 | 0 | 13 | | 50 | 68 | 87 | 108 | 135 | 159 | 188 | 207 | 228 | 240 | 246 | 255 | 255 | 255 |
| 48 | 0 | 12 | 28 | | 66 | 84 | 105 | 130 | 151 | 180 | 204 | 226 | 239 | 245 | 255 | 255 | 255 |
| 64 | 0 | 10 | 26 | 44 | | 82 | 103 | 124 | 146 | 170 | 198 | 220 | 234 | 242 | 252 | 255 | 255 |
| 80 | 0 | 8 | 23 | 42 | 60 | | 98 | 119 | 143 | 167 | 186 | 215 | 231 | 240 | 250 | 255 | 255 |
| 96 | 0 | 7 | 20 | 39 | 58 | 75 | | 116 | 138 | 159 | 180 | 210 | 228 | 239 | 249 | 255 | 255 |
| 112 | 0 | 7 | 18 | 36 | 55 | 73 | 90 | | 135 | 154 | 178 | 202 | 226 | 237 | 249 | 255 | 255 |
| 128 | 0 | 6 | 15 | 34 | 50 | 71 | 87 | 108 | | 148 | 170 | 199 | 218 | 234 | 248 | 255 | 255 |
| 144 | 0 | 5 | 14 | 31 | 47 | 68 | 84 | 103 | 122 | | 167 | 191 | 212 | 231 | 247 | 256 | 255 |
| 160 | 0 | 4 | 13 | 28 | 44 | 66 | 79 | 98 | 119 | 138 | | 183 | 210 | 228 | 244 | 254 | 255 |
| 176 | 0 | 3 | 12 | 26 | 42 | 63 | 74 | 95 | 114 | 130 | 151 | | 199 | 223 | 242 | 252 | 255 |
| 192 | 0 | 2 | 11 | 23 | 39 | 60 | 72 | 90 | 103 | 124 | 143 | 167 | | 215 | 239 | 250 | 255 |
| 208 | 0 | 1 | 10 | 20 | 36 | 56 | 68 | 82 | 98 | 116 | 135 | 159 | 180 | | 231 | 247 | 255 |
| 224 | 0 | 0 | 8 | 18 | 33 | 50 | 60 | 74 | 87 | 108 | 124 | 146 | 167 | 194 | | 244 | 255 |
| 240 | 0 | 0 | 0 | 7 | 26 | 42 | 52 | 58 | 68 | 87 | 103 | 127 | 143 | 162 | 199 | | 255 |
| 255 | 0 | 0 | 0 | 0 | 12 | 26 | 39 | 44 | 52 | 63 | 76 | 90 | 111 | 135 | 159 | 207 | |

FIG. 4
RELATED ART

| | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 25 | 39 | 55 | 74 | 95 | 116 | 143 | 167 | 194 | 212 | 231 | 245 | 250 | 255 | 255 | 255 |
| 16 | 0 | 16 | 36 | 52 | 71 | 90 | 111 | 138 | 162 | 191 | 210 | 230 | 242 | 247 | 255 | 255 | 255 |
| 32 | 0 | 13 | 32 | 50 | 68 | 87 | 108 | 135 | 159 | 188 | 207 | 228 | 240 | 246 | 255 | 255 | 255 |
| 48 | 0 | 12 | 28 | 48 | 66 | 84 | 105 | 130 | 151 | 180 | 204 | 226 | 239 | 245 | 255 | 255 | 255 |
| 64 | 0 | 10 | 26 | 44 | 64 | 82 | 103 | 124 | 146 | 170 | 198 | 220 | 234 | 242 | 252 | 255 | 255 |
| 80 | 0 | 8 | 23 | 42 | 60 | 80 | 98 | 119 | 143 | 167 | 186 | 215 | 231 | 240 | 250 | 255 | 255 |
| 96 | 0 | 7 | 20 | 39 | 58 | 75 | 96 | 116 | 138 | 159 | 180 | 210 | 228 | 239 | 249 | 255 | 255 |
| 112 | 0 | 7 | 18 | 36 | 55 | 73 | 90 | 112 | 135 | 154 | 178 | 202 | 226 | 237 | 249 | 255 | 255 |
| 128 | 0 | 6 | 15 | 34 | 50 | 71 | 87 | 108 | 128 | 148 | 170 | 199 | 218 | 234 | 248 | 255 | 255 |
| 144 | 0 | 5 | 14 | 31 | 47 | 68 | 84 | 103 | 122 | 144 | 167 | 191 | 212 | 231 | 247 | 255 | 255 |
| 160 | 0 | 4 | 13 | 28 | 44 | 66 | 79 | 98 | 119 | 138 | 160 | 183 | 210 | 228 | 244 | 254 | 255 |
| 176 | 0 | 3 | 12 | 26 | 42 | 63 | 74 | 95 | 114 | 130 | 151 | 176 | 199 | 223 | 242 | 252 | 255 |
| 192 | 0 | 2 | 11 | 23 | 39 | 60 | 72 | 90 | 103 | 124 | 143 | 167 | 192 | 215 | 239 | 250 | 255 |
| 208 | 0 | 1 | 10 | 20 | 36 | 58 | 68 | 82 | 98 | 116 | 135 | 159 | 180 | 208 | 231 | 247 | 255 |
| 224 | 0 | 0 | 8 | 18 | 33 | 50 | 60 | 74 | 87 | 108 | 124 | 146 | 167 | 194 | 224 | 244 | 255 |
| 240 | 0 | 0 | 0 | 7 | 26 | 42 | 52 | 58 | 68 | 87 | 103 | 127 | 143 | 162 | 199 | 240 | 255 |
| 255 | 0 | 0 | 0 | 0 | 12 | 28 | 39 | 44 | 52 | 63 | 76 | 90 | 111 | 135 | 159 | 207 | 255 |

FIG.6

61

| | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 25 | 39 | 55 | 74 | 95 | 116 | 143 | 167 | 194 | 212 | 231 | 245 | 250 | 255 | 255 | 255 |
| 16 | 0 | 16 | 36 | 52 | 71 | 90 | 111 | 138 | 162 | 191 | 210 | 230 | 242 | 247 | 255 | 255 | 255 |
| 32 | 0 | 13 | 32 | 50 | 68 | 87 | 108 | 135 | 159 | 188 | 207 | 228 | 240 | 246 | 255 | 255 | 255 |
| 48 | 0 | 12 | 28 | 48 | 66 | 84 | 105 | 130 | 151 | 180 | 204 | 226 | 239 | 245 | 255 | 255 | 255 |
| 64 | 0 | 10 | 26 | 44 | 64 | 82 | 103 | 124 | 146 | 170 | 198 | 220 | 234 | 242 | 252 | 255 | 255 |
| 80 | 0 | 8 | 23 | 42 | 60 | 80 | 98 | 119 | 143 | 167 | 186 | 215 | 231 | 240 | 250 | 255 | 255 |
| 96 | 0 | 7 | 20 | 39 | 58 | 75 | 96 | 116 | 138 | 159 | 180 | 210 | 228 | 239 | 249 | 255 | 255 |
| 112 | 0 | 7 | 18 | 36 | 55 | 73 | 90 | 112 | 135 | 154 | 178 | 202 | 226 | 237 | 249 | 255 | 255 |
| 128 | 0 | 6 | 15 | 34 | 50 | 71 | 87 | 108 | 128 | 148 | 170 | 199 | 218 | 234 | 248 | 255 | 255 |
| 144 | 0 | 5 | 14 | 31 | 47 | 68 | 84 | 103 | 122 | 144 | 167 | 191 | 212 | 231 | 247 | 255 | 255 |
| 160 | 0 | 4 | 13 | 28 | 44 | 66 | 79 | 98 | 119 | 138 | 160 | 183 | 210 | 228 | 244 | 254 | 255 |
| 176 | 0 | 3 | 12 | 26 | 42 | 63 | 74 | 95 | 114 | 130 | 151 | 176 | 199 | 223 | 242 | 252 | 255 |
| 192 | 0 | 2 | 11 | 23 | 39 | 60 | 72 | 90 | 103 | 124 | 143 | 167 | 192 | 215 | 239 | 250 | 255 |
| 208 | 0 | 1 | 10 | 20 | 36 | 58 | 68 | 82 | 98 | 116 | 135 | 159 | 180 | 208 | 231 | 247 | 255 |
| 224 | 0 | 0 | 8 | 18 | 33 | 50 | 60 | 74 | 87 | 108 | 124 | 146 | 167 | 194 | 224 | 244 | 255 |
| 240 | 0 | 0 | 0 | 7 | 26 | 42 | 52 | 58 | 68 | 87 | 103 | 127 | 143 | 162 | 199 | 240 | 255 |
| 255 | 0 | 0 | 0 | 0 | 12 | 28 | 39 | 44 | 52 | 63 | 76 | 90 | 111 | 135 | 159 | 207 | 255 |

METHOD AND APPARATUS FOR DRIVING LIQUID CRYSTAL DISPLAY DEVICE

This application claims the benefit of the Korean Patent Application No. P2004-49638 filed on Jun. 29, 2004, which is hereby incorporated by reference.

BACKGROUND OF THE INVENTION

1. Field of the Invention

The present invention relates to a liquid crystal display device, and more particularly, to an apparatus and a method for driving a liquid crystal display device that reduces the heat generated by a device with reliable operation.

2. Description of the Related Art

A liquid crystal display device controls the light transmissivity of liquid crystal cells in accordance with a video signal to display a picture. An active matrix type of liquid crystal display device having a switch device formed at each liquid crystal cell is advantageous for motion picture because the switch device can be actively controlled. The switch device used in the active matrix liquid crystal display device is usually a thin film transistor (hereinafter, referred to as "TFT").

The liquid crystal display device, as shown in Formula 1 and 2, has a disadvantage in that its response speed is slow due to the unique characteristic of liquid crystal such as viscosity and elasticity thereof.

$$\tau_r \propto \frac{\gamma d^2}{\Delta\varepsilon|V_a^2 - V_F^2|} \quad \text{[FORMULA 1]}$$

Here, $\tau_r$ represents a rise time when a voltage is applied to liquid crystal, $V_a$ represents an applied voltage, $V_F$ represents a Freederick Transition Voltage where a liquid crystal molecule starts a tilt motion, d represents a cell gap of a liquid crystal cell, and γ (gamma) represents the rotational viscosity of the liquid crystal molecule.

$$\tau_f \propto \frac{\gamma d^2}{K} \quad \text{[FORMULA 2]}$$

Here, $\tau_f$ represents a fall time when the liquid crystal is restored to its original location by an elastic restitutive force after the voltage applied to the liquid crystal is turned off, and K represents the unique elastic modulus of liquid crystal.

The response speed of the liquid crystal of twisted nematic TN mode (which is most commonly used) might differ according to the physical properties and cell gap of a liquid crystal material, but conventionally, the rise time is 20~80 ms and the falling time is 20~30 ms. The response speed of the liquid crystal is longer than one frame period (NTSC: 16.67 ms). Because of this, the signal will be in the next frame before the voltage being charged in the liquid crystal cell reaches a desired voltage, as shown in FIG. 1. Thus, a motion blurring phenomenon is generated in a screen showing a motion picture.

Referring to FIG. 1, a liquid crystal display device of the related art could not express a desired color and brightness because the display brightness BL corresponding thereto does not reach the desired brightness when a data VD is changed from one level to another level. As a result, the liquid crystal display device has the motion blurring phenomenon in the motion picture, and has its picture quality dropped due to the deterioration of contrast ratio.

In order to overcome the slow response speed of the liquid crystal display device, U.S. Pat. No. 5,495,265 or PCT International Publication No. WO99/05567 has suggested a method of modulating a data in accordance with the existence or absence of the change of the data using a look-up table, hereinafter referred to as "high-speed driving method". The high speed driving method modulates the data with the principle shown in FIG. 2.

Referring to FIG. 2, the high speed driving method modulates an input data VD into a pre-set modulated data MVD, and the modulated data MVD is applied to the liquid crystal cell to get the desired brightness MBL. The high speed driving method has the value of $|V_a^2 - V_F^2|$ in Formula 1 on the basis of the existence or absence of change of the data to get a desired brightness corresponding to the brightness value of the input data within one frame period. Accordingly, the liquid crystal display device using the high speed driving method compensates for the slow response time of liquid crystal by modulating the data value to ease the motion blurring phenomenon associated with a motion picture.

In other words, the high speed driving method modulates the data of the current frame to a pre-set modulated data if there is any change between the data when the data are compared between the previous frame and the current frame.

The modulated data needed in the high speed driving method is determined with the method shown in FIG. 3. Referring to FIG. 3, a modulated data determination method, in a step S1, applies a data voltage to a test piece liquid crystal display panel in relation to data with a designated difference, measures the change of brightness of the test piece liquid crystal display and changes the data voltage until it reaches to the target brightness within a desired time. Through this process, the first modulated data are determined, wherein the first modulated data reach the target brightness within the desired time in the data with a designated distance.

FIG. 4 represents an example of the first modulated data. In FIG. 4, the data of the leftmost column represents the data of the previous frame Fn−1 and the data of the uppermost row represents the data of the current frame Fn. The first modulated data of FIG. 4 include 17×17 numbers of modulated data which are determined with 17 data gaps.

In this way, after the first modulated data are determined, the modulated data determination method, in a step S2, automatically determines a second modulated data using a distance compensating method. Here, the second modulated data corresponds to each of 16 data in the gap between two adjacent first distance compensating data and are determined with a designated distance using software. The second modulated data have a linear relation with the first distance compensating data. The first modulated data and the second modulated data determined in the steps S1 and S2 are stored in a read only memory ROM in a step S3.

On the other hand, if all of the modulated data determined by the modulated data determination method of the related art are stored in the ROM, the capacity of the ROM must be large and a current flow when accessing the modulated data is large. Thus, the heat generation of the ROM increases and the reliability of operation is deteriorated. For example, the number of the total modulated data stored at the ROM is 256×256=65536 assuming that there are 256 gray levels. The modulated data is 1 byte (or 8 bits), thus the minimum capacity of the ROM to store the 65536 modulated data is 65536×8=524288 bits.

SUMMARY OF THE INVENTION

Accordingly, the present invention is directed to a method and apparatus for driving liquid crystal display device that substantially obviates one or more of the problems due to limitations and disadvantages of the related art.

An object of the present invention is to provide an apparatus and a driving method for a liquid crystal display device that reduces heat generation in an LCD device and securing the reliability of operation.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantaged and in accordance with the purpose of the present invention, as embodied and broadly described, a driving method for a liquid crystal display device comprises the steps of determining a first modulated data; storing the first modulated data in a timing controller; judging an area existing between the first modulated data using the present frame data and the previous frame data; calculating a second modulated data through an approximation in the area; and displaying at least one of the first modulated data and the second modulated data.

In another aspect, a driving apparatus for a liquid crystal display device comprises a liquid crystal display panel having a plurality of data lines and a plurality of gate lines crossing each other; a timing controller to store a first modulated data; an area judgment unit to judge an area existing between the first modulated data using the present frame data and the previous frame data; a calculating unit to calculate a second modulated data through an approximation in the area; and a data driver to supply at least one of the first modulated data and the second modulated data to the liquid crystal display panel.

In another aspect, driving apparatus for a liquid crystal display device comprises means for determining a first modulated data; means for storing the first modulated data in a timing controller; means for judging an area existing between the first modulated data using the present frame data and the previous frame data; means for calculating a second modulated data through an approximation in the area; and means for displaying at least one of the first modulated data and the second modulated data.

In another aspect, a driving method for a liquid crystal display device comprises the steps of determining a first modulated data; storing the first modulated data in a timing controller; calculating a second modulated data through an approximation for values between values of the first modulated data using the present frame data and the previous frame data; and displaying at least one of the first modulated data and the second modulated data.

In another aspect, a driving apparatus for a liquid crystal display device comprises a timing controller to store a first modulated data; a calculating unit to calculate a second modulated data through an approximation for values between values of the first modulated data using the present frame data and the previous frame data; and a data driver to supply at least one of the first modulated data and the second modulated data to a liquid crystal display panel of the liquid crystal display device.

In another aspect, a driving apparatus for a liquid crystal display device comprises means for determining a first modulated data; means for storing the first modulated data in a timing controller; means for calculating a second modulated data through an approximation for values between values of the first modulated data using the present frame data and the previous frame data; and means for displaying at least one of the first modulated data and the second modulated data.

In another aspect, a liquid crystal display device comprises a liquid crystal display panel having a plurality of data lines and a plurality of gate lines crossing each other; and a driving apparatus including a liquid crystal display panel having a plurality of data lines and a plurality of gate lines crossing each other, a timing controller to store a first modulated data, a calculating unit to calculate a second modulated data through an approximation for values between values of the first modulated data using the present frame data and the previous frame data, and a data driver to supply at least one of the first modulated data and the second modulated data to the data lines of the liquid crystal display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 4 is a diagram representing an example of a related art first modulated data with a designated distance;

FIG. 6 is a diagram representing an imaginary modulated data area;

DETAILED DESCRIPTION OF THE PREFERRED EMBODIMENTS

Reference will now be made in detail to the preferred embodiments of the present invention, examples of which are illustrated in the accompanying drawings. Hereinafter, embodiments of the present invention will be described in detail with reference to FIGS. 5 to 8.

Figure 1:
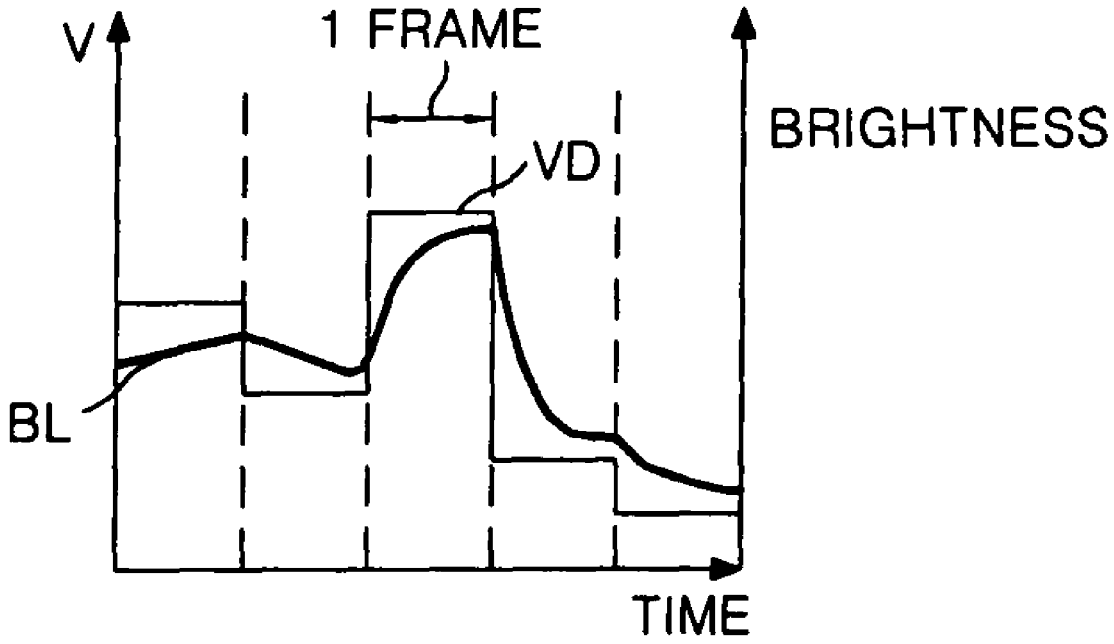
FIG. 1 RELATED ART
FIG. 1 is a waveform diagram representing a brightness change in accordance with data in a related art liquid crystal display device.
Figure 2:
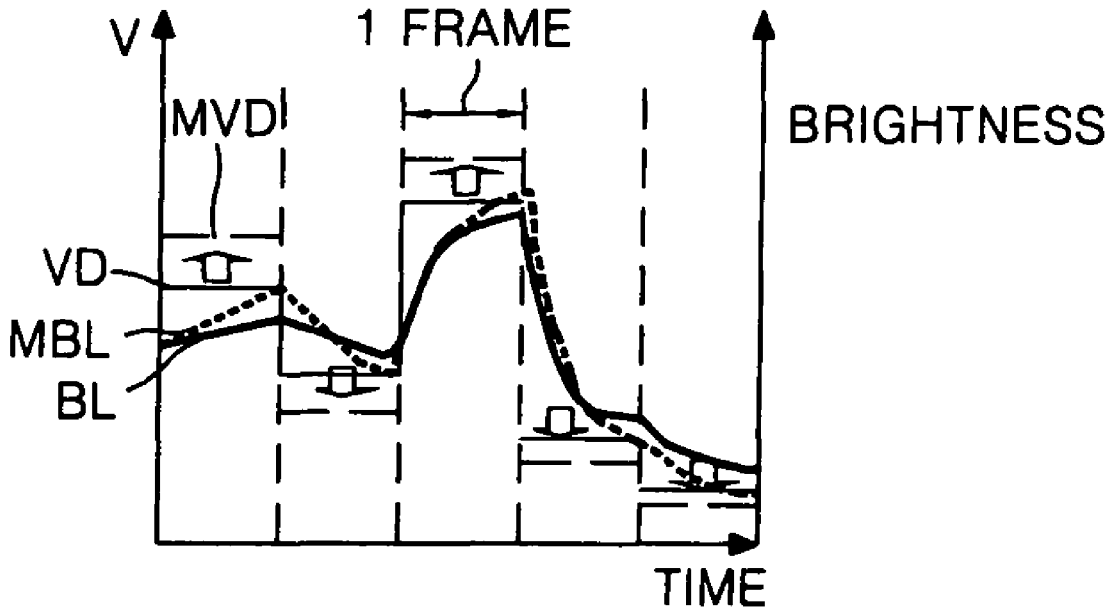
FIG. 2 RELATED ART
FIG. 2 is a waveform diagram representing an example of a brightness change in accordance with a related art data modulation in a high speed driving method.
Figure 3:
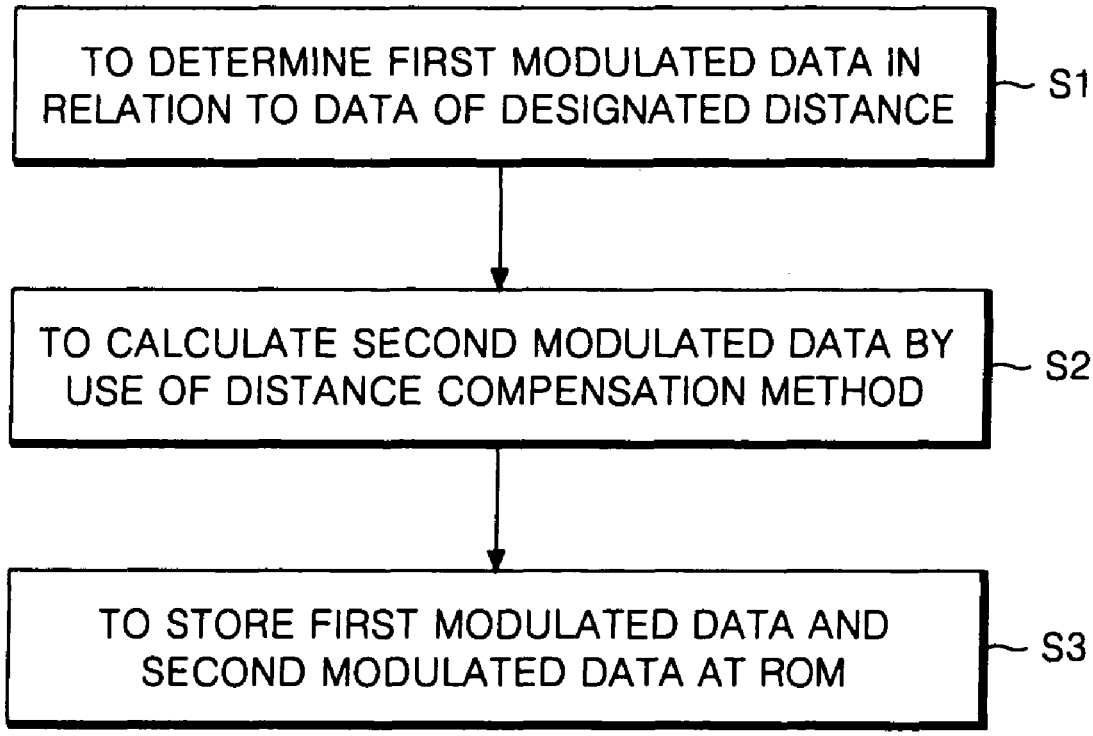
FIG. 3 RELATED ART
FIG. 3 is a flow chart representing a related art modulated data determination method in the high speed driving method.
Figure 5:
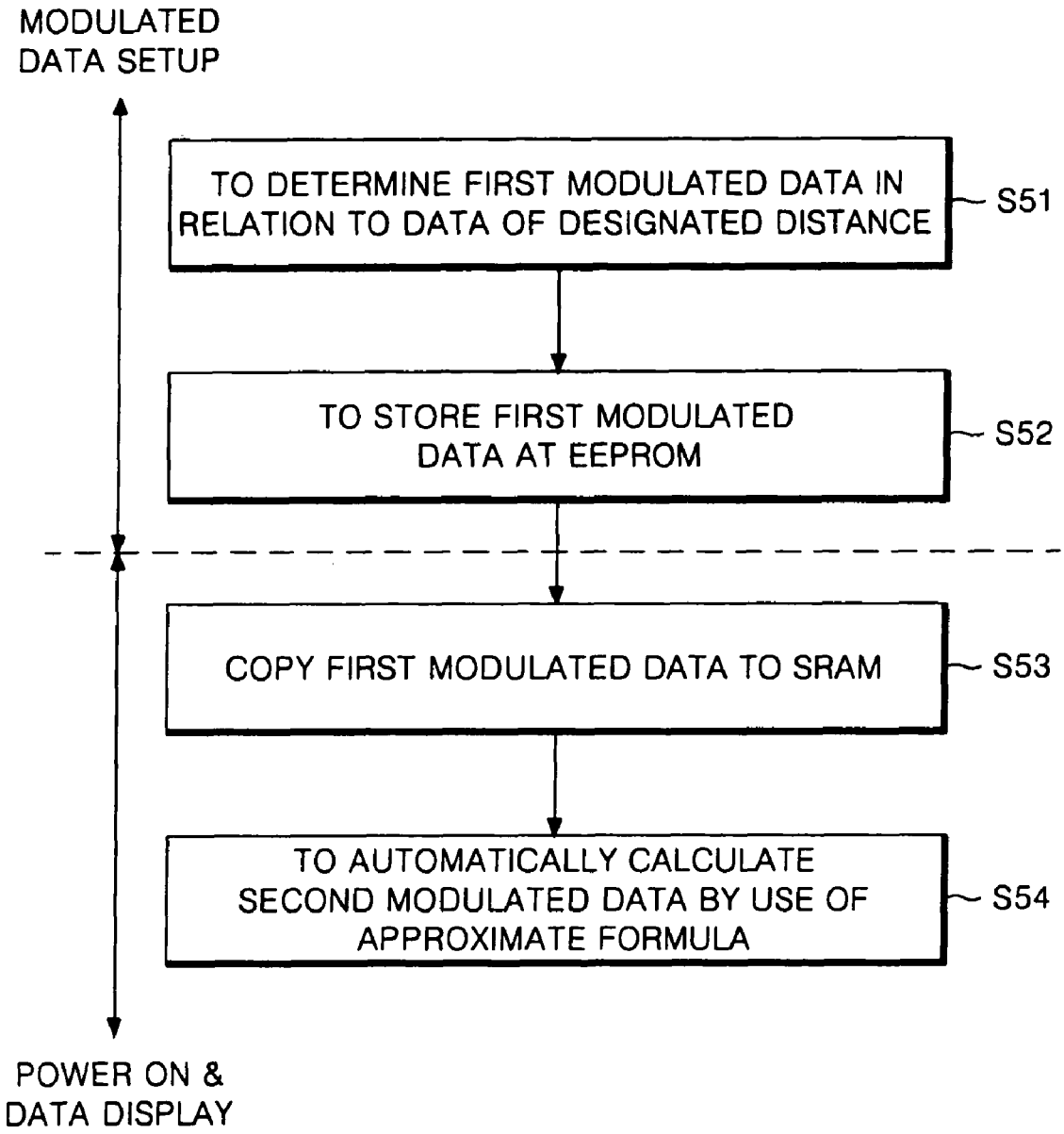
FIG. 5 is a flow chart representing a modulated data determination method according to an exemplary embodiment of the present invention.

FIG. 5 is a flow chart of a modulated data determination method according to an exemplary embodiment of the present invention. Referring to FIG. 5, a modulated data determination method of a liquid crystal display device according to the present invention, in step S51, applies a data voltage to a test piece liquid crystal display panel in relation to data with a designated distance to measure the brightness change of the test piece liquid crystal display panel and changes the data voltage until it reaches a target brightness within a desired time. Through this process, the first modulated data are determined, wherein the first modulated data reach the target brightness within the desired time in the data with a designated distance. The first modulated data can be determined to have 17×17 numbers of modulated data which are determined with 17 data gaps as shown in FIG. 4.

After the first modulated data is determined, the modulated data determination method of the liquid crystal display device according to the present invention, in step S52, stores the first modulated data in a ROM, e.g., EEPROM.

If the first modulated data are as in FIG. 4, the total capacity of the first modulated data stored at the EEPROM is 17×17×8=2312 bits. Accordingly, the memory capacity of the EEPROM is reduced to a 1/250 level in a large scale in comparison with the capacity of a conventional memory where modulated data of all gray levels are stored.

After power is applied to a driving apparatus of the liquid crystal display device according to the present invention, in step S53, the first modulated data stored at the EEPROM are copied to a SRAM. The memory capacity of the SRAM is three times the EEPROM, and therefore it has a capacity of 6936 bits.

The driving method of the liquid crystal display device, if a digital video data is input to the driving apparatus of the liquid crystal display device, calculates a second modulated data, which are not stored at the SRAM, by a linear approximate formula using a first modulated data stored at the SRAM and the data of the present frame and the previous frame. The driving method of the liquid crystal display device according to the present invention modulates the data inputted for the current frame period by use of the second modulated data calculated by the linear approximate formula and the first modulated data stored at the SRAM, and displays the modulated data in a liquid crystal display panel.

An example of a calculation process of the second modulated data is explained in conjunction with FIG. 6 and Formulas 3 and 4. In FIG. 6, the data of the leftmost column represents the data of the previous frame $F_{n-1}$ and the data of the uppermost row represents the data of the current frame Fn.

Assuming that the previous frame data $F_{n-1}$ is 105 and the present frame data $F_n$ is 57, an unknown second modulated data corresponding to the data is located within an imaginary modulated data area 61 between the first modulated data "39", "58", "36", "55" in FIG. 6. The modulated data determination method of the liquid crystal display device according to the present invention, if the imaginary modulated data area 61 is judged as in FIG. 6, substitutes the first modulated data, which are adjacent to a horizontal axis (or X axis) in the above and below directions, to a linear approximate formula as in Formula 1 in the imaginary modulated data area 61.

$$Y=(y2-y1)(x-x1)/(x2-x1)+y1 \quad \text{[FORMULA 3]}$$

Here, x2−x1 is the difference between the two first modulated data which are adjacent to a horizontal axis within the imaginary modulated data area 61, and y2 and y1 are two first modulated data adjacent to the horizontal axis within the imaginary modulated data area 61. Also, x is the data of the present frame Fn, and x1 is the first modulated data which has the smaller value of the two first modulated data that are adjacent to the horizontal axis within the imaginary modulated data area 61.

The first modulated data adjacent to the two horizontal axes within the imaginary modulated data area 61 are 39, 58 and 36, 55. The data of the present frame Fn is "57". If these values are substituted to Formula 3 and rounded, then the two values of Y=(58−39)(57−48)/16+39=50 and Y=(55−36)(57−48)/16+36=47 are calculated. With these two values, an approximate formula of vertical direction according to Formula 4 below can be derived.

$$Y=(50-47)(x'-96)/16+50$$

Here, x' value is the data of the previous frame Fn−1. Accordingly, if "105" is substituted with x', the value of Y, i.e., the second modulated data, is calculated to be "52".

Figure 7:
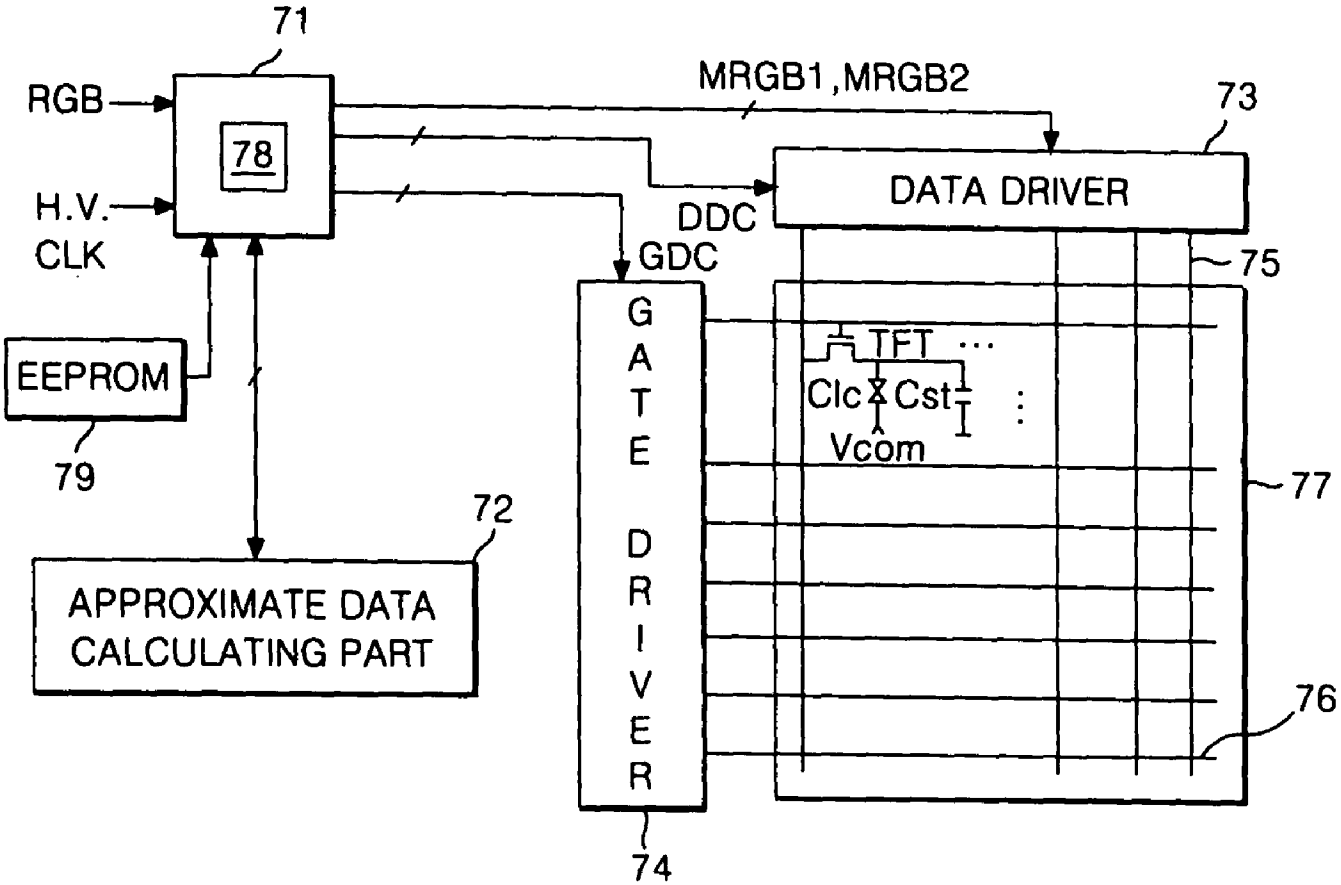
FIG. 7 is a block diagram representing a driving apparatus of a liquid crystal display device according to an exemplary embodiment of the present invention.

FIG. 7 is a block diagram representing a driving apparatus of a liquid crystal display device according to an exemplary embodiment of the present invention. Referring to FIG. 7, the driving apparatus of the liquid crystal display device includes a liquid crystal display panel 77 where a data line 75 and a gate line 76 cross each other and a TFT is formed to drive a liquid crystal cell Clc at an intersection thereof; a data driver 73 to supply data to the data line 75 of the liquid crystal display panel 77; a gate driver 74 to supply a scan pulse to the gate line 76; an approximate data calculating part 72 to calculate a second modulated data by use of a linear approximate formula; an EEPROM 79 at which first modulated data are stored; and a timing controller 71 where a SRAM 78 is built in.

The liquid crystal display panel 77 has liquid crystal injected between two glass substrates, and the data lines 75 and the gate lines 76 cross each other on a lower glass substrate. The TFT formed at the intersection of the data lines 75 and the gate lines 76 supplies the data from the data lines 75 to the liquid crystal cell Clc in response to the scan pulse from the gate line 76. For this, a gate electrode of the TFT is connected to the gate line 76, a source electrode is connected to the data line 75. Also, a drain electrode of the TFT is connected to a pixel electrode of the liquid crystal cell Clc. Further, a storage capacitor Cst for sustaining the voltage of the liquid crystal cell Clc is formed on the lower glass substrate of the liquid crystal display panel 77. The storage capacitor Cst might be formed between the liquid crystal cell Clc and the previous gate line 76, and might be formed between the liquid crystal cell Clc and a separate common line.

The first modulated data as in FIG. 6 are stored at the EEPROM 79 in the form of a lookup table, and if power is supplied to the driving apparatus, the stored first modulated data MRGB1 of the lookup table are supplied to the SRAM 78 within the timing controller 71.

The timing controller 71 generates a gate control signal GDC to control the gate driver 74, a data control signal DDC to control the data driver 73 and a control signal to control a modulation portion of the approximate data calculating part 72 using a vertical/horizontal synchronization signal V,H and a pixel clock CLK. The timing controller 71 samples a digital video data RGB in accordance with the pixel clock CLK to supply the data RGB to the modulating portion of the approximate data calculating part 72 and to supply the first modulated data MRGB1 copied to the SRAM 78 and the second modulated data MRGB2 from the approximate data calculating portion 72. The SRAM 78 built in the timing controller 71 stores only the first modulated data MRGB2. Thus, the amount of access decreases and the current flow for every access is reduced, thereby reducing the heat generation. Accordingly, the timing controller 71 has lower heat generation and more secure operation reliability even though it has the SRAM 78 therein.

The approximate data calculating part 72 judges an imaginary modulated data area where an unknown second modulated data might exist in the lookup table within the SRAM 78, and calculates the second modulated data MRGB2 in the imaginary modulated data area using a linear approximate formula, such as Formulas 3 and 4.

The first modulated data MRGB1 and the second modulated data MRGB2 satisfy the condition of the following formulas 5 to 7.

$$RGB(Fn)<RGB(Fn-1)\rightarrow MRGB1,MRGB2<RBG(Fn) \quad \text{[FORMULA 5]}$$

$$RGB(Fn)=RGB(Fn-1)\rightarrow MRGB1,MRGB2=RBG(Fn) \quad \text{[FORMULA 6]}$$

$$RGB(Fn)>RGB(Fn-1)\rightarrow MRGB1,MRGB2>RBG(Fn) \quad \text{[FORMULA 7]}$$

As can be seen in Formulas 5 to 7, the modulated data MRGB1, MRGB2 have larger values than the data value in the present frame $F_n$ if the pixel data value in the same pixel becomes larger in the present frame $F_n$ than in the previous frame $F_{n-1}$. However, on the other hand, the modulated data MRGB1, MRGB2 are smaller than the data value in the present frame Fn if the data value becomes smaller in the present frame $F_n$ than in the previous frame $F_{n-1}$. Also, the modulated data MRGB1, MRGB2 are set to be the same value as the data value in the present frame $F_n$ if the pixel data value in the same pixel is equal in the present frame $F_n$ and in the previous frame $F_{n-1}$.

The timing controller 71 can be integrated with the approximate data calculating part 72 into one chip. The data driver 73 includes a shift register; a register to temporarily store the modulated data MRGB1, MRGB2 from the timing controller 71; a latch to store data by one lines in response to the clock signal from the shift register and to output the stored data of one line at the same time; a digital/analog converter to select an analog positive/negative gamma compensation voltage corresponding to the digital data value from the latch; a multiplexer to select the data line 75 to which the positive/negative gamma compensation voltage is supplied; and an output buffer connected between the multiplexer and the data line. The data driver 73 receives the modulated data MRGB1, MRGB2 and supplies the modulated data MRGB1, MRGB2 to the data lines 75 of the liquid crystal display panel 77 under the control of the timing controller 71.

The gate driver 74 includes a shift register to sequentially generate a scan pulse in response to a gate control signal GDC from the timing controller 71; a level shifter to shift the swing width of the scan pulse to a level which is suitable for the driving of the liquid crystal cell Clc; and an output buffer. The gate driver 74 supplies the scan pulse to the gate line 76 to turn on the TFTs connected to the gate line 76, thereby selecting the liquid crystal cells Clc of one horizontal line to which a pixel voltage of the data, i.e., analog gamma compensation voltage, is to be supplied. The data generated from the data driver 73 are synchronized with the scan pulse to be supplied to the liquid crystal cells Clc of the selected one horizontal line.

Figure 8:
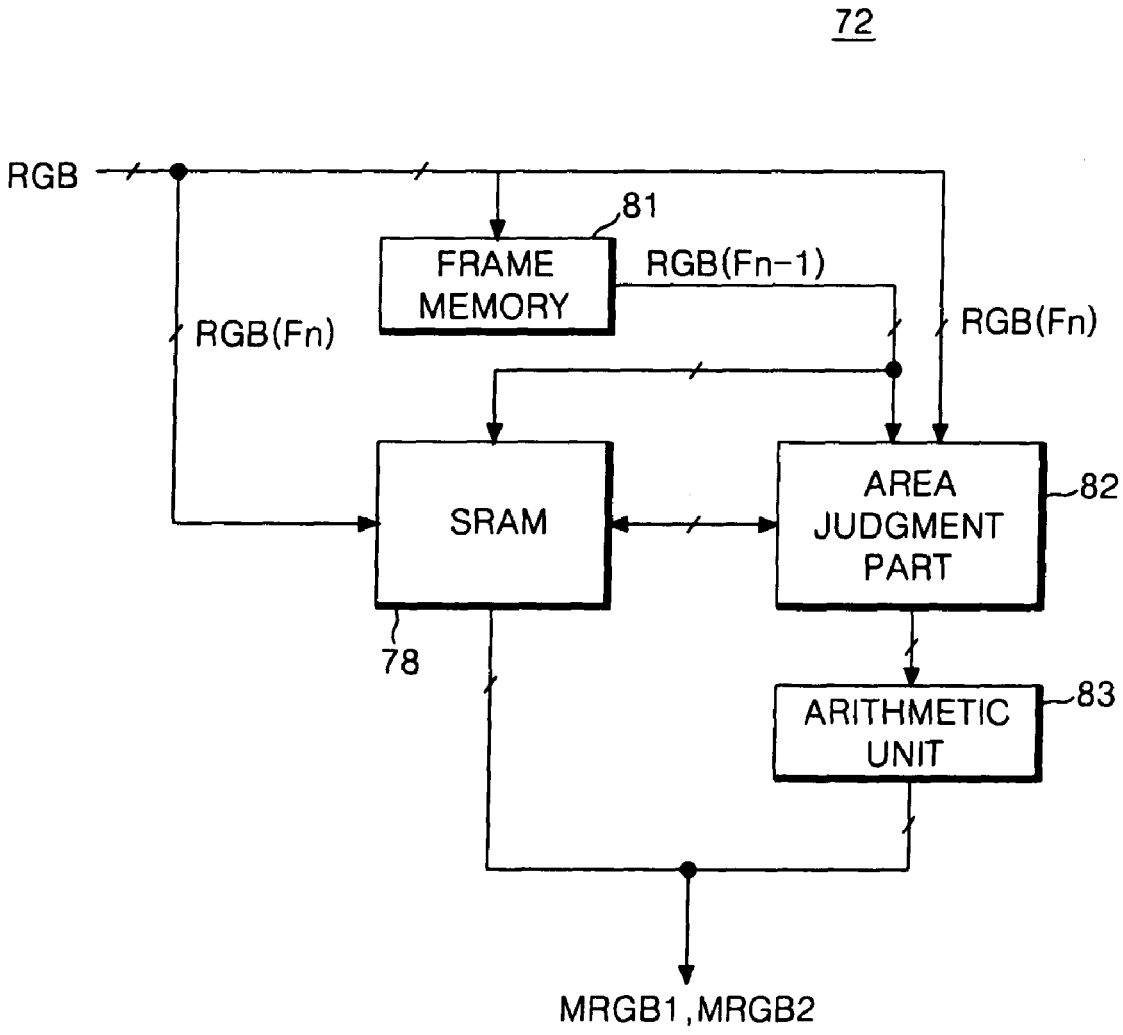
FIG. 8 is a block diagram representing an approximate data calculating portion and an SRAM of a timing controller shown in FIG. 7.

FIG. 8 is a block diagram representing an SRAM 78 and an approximate data calculating part 72 in detail. Referring to FIG. 8, the SRAM 78 has the present frame data RGB($F_n$) and the previous frame data RGB($F_{n-1}$) from the frame memory 81 as its address and supplies the first modulated data MRGB1 indicated by the address to the data driver 73.

The frame memory 81 stores the input digital video data of one frame portion and then outputs the stored data to delay the data by one frame period. The frame memory 81 might be built in the timing controller 71.

The approximate data calculating part 72 includes an area judgment part 82 and an arithmetic unit 83. The area judgment part 82 judges the imaginary modulated data area in the first modulated data lookup table within the SRAM 78 by use of the present frame data RGB($F_n$) and the previous frame data RGB($F_{n-1}$) from the frame memory 81.

The arithmetic unit 83, as mentioned above, calculates the second modulated data MRGB2 in the imaginary modulated data area by use of the linear approximate formula, such as Formulas 3 and 4, and supplies it to the data driver 73.

As described above, the apparatus and method of the liquid crystal display device according to the present invention stores the first modulated data of the designated distance in the memory and calculates the modulated data other than the first modulated data by a linear approximate formula. Thus, the capacity of the memory can be reduced. Also, the heat generation of the memory and the timing controller in which the memory is built in can be minimized. Accordingly, secure operation reliability of the timing controller can be achieved.

It will be apparent to those skilled in the art that various modifications and variations can be made in the method and apparatus for driving liquid crystal display device of the present invention without departing from the spirit or scope of the invention. Thus, it is intended that the present invention cover the modifications and variations of this invention provided they come within the scope of the appended claims and their equivalents.

What is claimed is:

1. A driving method for a liquid crystal display device, comprising the steps of:

determining a plurality of first modulated data during a set-up of the first modulated data;

storing the first modulated data in a first memory as a lookup table during the set-up of the first modulated data;

copying the first modulated data to a second memory in a timing controller from the first memory after power is supplied to the driving apparatus of the liquid crystal display device;

judging an area existing between the first modulated data using the present frame data and the previous frame data, wherein the area is located between a predetermined number of the first modulated data from the plurality of first modulated data, and each value of the predetermined number of the first modulated data is adjacent to each value of the present frame data and the previous frame data in horizontal and vertical directions within the first memory;

calculating a second modulated data through a linear approximate formula $Y=(y2-y1)(x-x1)/(x2-x1)+y1$ in the area based on the predetermined number of the first modulated data within the area after power is supplied to the driving apparatus of the liquid crystal display device, wherein x2−x1 in the linear approximate formula is the difference between the two first modulated data which are adjacent to a horizontal axis within the imaginary modulated data area, y2 and y1 are two first modulated data adjacent to the horizontal axis within the imaginary modulated data area, x is the data of the present frame Fn, and x1 is the first modulated data which has the smaller value of the two first modulated data that are adjacent to the horizontal axis within the imaginary modulated data area; and displaying at least one of the first modulated data and the second modulated data;

wherein the first and second memories store only the first modulated data except the second modulated data.

2. The driving method according to claim 1, wherein the displaying step includes supplying at least one of the first modulated data and the second modulated data to the liquid crystal display panel.

3. The driving method according to claim 2, wherein the displaying step further includes supplying a scan pulse to scan lines of the liquid crystal display panel.

4. The driving method according to claim 1, wherein the second memory is disposed in the timing controller.

5. The driving method according to claim 1, wherein the second memory is a SRAM.

6. The driving method according to claim 1, wherein the first memory is an EEPROM.

7. A driving apparatus for a liquid crystal display device, comprising:

a liquid crystal display panel having a plurality of data lines and a plurality of gate lines crossing each other;

a first memory to store a plurality of first modulated data as a lookup table during the set-up of the first modulated data;

a second memory to which the first modulated data are copied from the first memory after power is supplied to the driving apparatus of the liquid crystal display device;

an area judgment unit to judge an area existing between a predetermined number of the first modulated data from the first modulated data using the present frame data and the previous frame data, wherein each value of the predetermined number of the first modulated data is adjacent to each value of the present frame data and the previous frame data in horizontal and vertical directions within the first memory;

a calculating unit to calculate a second modulated data through a linear approximate formula $Y=(y2-y1)(x-x1)/(x2-x1)+y1$ in the area based on the predetermined number of the first modulated data within the area after power is supplied to the driving apparatus of the liquid crystal display device, wherein $x2-x1$ in the linear approximate formula is the difference between the two first modulated data which are adjacent to a horizontal axis within the imaginary modulated data area, $y2$ and $y1$ are two first modulated data adjacent to the horizontal axis within the imaginary modulated data area, $x$ is the data of the present frame Fn, and $x1$ is the first modulated data which has the smaller value of the two first modulated data that are adjacent to the horizontal axis within the imaginary modulated data area; and a data driver to supply at least one of the first modulated data and the second modulated data to the liquid crystal display panel;

wherein the first and second memories store only the first modulated data except the second modulated data.

8. The driving apparatus according to claim 7, wherein the second memory is disposed in a timing controller.

9. The driving apparatus according to claim 7, wherein the first memory is an EEPROM.

10. The driving apparatus according to claim 7, wherein the second memory is a SRAM.

11. The driving apparatus according to claim 7, further comprising a scan driver to supply a scan pulse to scan lines of the liquid crystal display panel.

12. The driving apparatus according to claim 7, wherein the first modulated data is determined according to a designated difference in brightness levels.

* * * * *